US008402699B2

(12) United States Patent
Henriott

(10) Patent No.: US 8,402,699 B2
(45) Date of Patent: Mar. 26, 2013

(54) SLIDING PRIVACY DOOR FOR PARTITION SYSTEMS

(75) Inventor: Jay M. Henriott, Jasper, IN (US)

(73) Assignee: Kimball International, Inc., Jasper, IN (US)

( * ) Notice: Subject to any disclaimer, the term of this patent is extended or adjusted under 35 U.S.C. 154(b) by 48 days.

(21) Appl. No.: 13/178,001

(22) Filed: Jul. 7, 2011

(65) Prior Publication Data

US 2012/0011789 A1 Jan. 19, 2012

Related U.S. Application Data

(60) Provisional application No. 61/364,098, filed on Jul. 14, 2010.

(51) Int. Cl.
*E04H 3/00* (2006.01)

(52) U.S. Cl. ..... 52/36.1; 52/239; 52/205; 52/207; 52/243.1; 52/475.1; 49/410; 49/411

(58) Field of Classification Search ..... 52/36.1, 52/36.2, 205, 207, 239, 243, 243.1, 474, 52/475.1, 476, 481.2, 483.1; 16/87 R, 90, 16/91, 94 R, 95 R, 96 R, 87 B, 105; 49/404, 49/409–411

See application file for complete search history.

(56) References Cited

U.S. PATENT DOCUMENTS

| | | | | |
|---|---|---|---|---|
| 1,098,516 | A | 6/1914 | Matthews | |
| 3,693,293 | A | 9/1972 | Egan, Jr. et al. | |
| 3,839,834 | A | 10/1974 | Goddard | |
| 4,325,204 | A * | 4/1982 | Martine | 49/372 |
| 4,513,535 | A * | 4/1985 | Uphoff | 49/409 |
| 4,742,645 | A * | 5/1988 | Johnston | 49/372 |
| 4,785,598 | A | 11/1988 | Stronach | |
| 4,791,757 | A * | 12/1988 | Orlando | 49/360 |
| 4,833,840 | A | 5/1989 | Kalischewski et al. | |
| 5,121,817 | A | 6/1992 | Garrido et al. | |
| 5,125,202 | A | 6/1992 | Kissinger | |
| 5,301,477 | A | 4/1994 | Rellinger et al. | |
| 5,309,686 | A | 5/1994 | Underwood et al. | |
| 5,394,658 | A | 3/1995 | Schreiner et al. | |
| 5,452,547 | A | 9/1995 | Baloga et al. | |
| 5,675,946 | A * | 10/1997 | Verbeek et al. | 52/205 |
| 5,873,205 | A | 2/1999 | Hanlon et al. | |
| 5,966,879 | A * | 10/1999 | Verbeek et al. | 52/205 |
| 6,058,655 | A | 5/2000 | Gravel | |
| 6,151,852 | A | 11/2000 | Linn et al. | |
| 6,250,016 | B1 | 6/2001 | Gravel | |
| 6,415,553 | B1 * | 7/2002 | Krayer et al. | 52/36.1 |
| 6,435,253 | B1 * | 8/2002 | Steeves et al. | 160/135 |
| 6,446,396 | B1 | 9/2002 | Marangoni et al. | |
| 6,553,731 | B2 | 4/2003 | Hsueh | |

(Continued)

FOREIGN PATENT DOCUMENTS

JP 2-282591 11/1990

*Primary Examiner* — Basil Katcheves
*Assistant Examiner* — Beth Stephan
(74) *Attorney, Agent, or Firm* — Faegre Baker Daniels LLP

(57) ABSTRACT

An office partition system including at least first and second panels and a sliding privacy door guidably supported against the first panel via an elongated horizontal guide. The elongated horizontal guide has a channel that receives the privacy door and a mounting structure for mounting the guide to a horizontal track of the first panel. The elongated horizontal guide has a width that is substantially equivalent to the width of the first panel. The privacy door includes wheels that may support the entire weight of the privacy door. The privacy door may move from a first, open position allowing access to an interior space of the office partition system via an opening to a second, closed position restricting access to the interior space via the opening.

19 Claims, 5 Drawing Sheets

U.S. PATENT DOCUMENTS

| | | | | |
|---|---|---|---|---|
| 6,807,784 | B2 | 10/2004 | Hsueh | |
| 6,880,610 | B1 * | 4/2005 | Bush | 160/202 |
| 8,079,179 | B2 * | 12/2011 | Lemming | 49/409 |
| 2004/0003556 | A1 * | 1/2004 | Zerbst | 52/220.7 |
| 2005/0011138 | A1 * | 1/2005 | Ball et al. | 52/36.1 |
| 2008/0173779 | A1 * | 7/2008 | Beno et al. | 248/309.1 |
| 2009/0007506 | A1 | 1/2009 | Miyata et al. | |
| 2009/0272707 | A1 | 11/2009 | Layton | |

* cited by examiner

SLIDING PRIVACY DOOR FOR PARTITION SYSTEMS

CROSS-REFERENCE TO RELATED APPLICATIONS

This application claims priority under Title 35, U.S.C. §119(e) to U.S. Provisional Patent Application Ser. No. 61/364,098, filed Jul. 14, 2010, entitled SLIDING PRIVACY DOOR FOR PARTITION SYSTEMS, the entire disclosure of which is hereby expressly incorporated by reference herein.

BACKGROUND

1. Field of the Invention

The present invention relates to office partition systems, and in particular to the attachment and use of sliding privacy doors on panels of office partition systems to provide or restrict access to office spaces formed by the office partition systems.

2. Description of the Related Art

Office partition systems may include a plurality of panels that form an interior space. Often, a person may utilize that interior space as an office or meeting room, for example. The office may include, for example, a desk, chairs, and other items appropriate for an office environment. A person may access to the interior space via an opening formed between at least two of the panels.

At times, a person may desire to have privacy within the interior space or office. Known privacy doors, however, have been heavy and unwieldy to attach to a panel and/or expensive or cumbersome to manufacture due to custom designs and additional required components.

For example, some privacy doors known in the art have been designed as pocket doors which are dimensioned to be received entirely within a cavity of an office panel. Pocket doors, however, require custom panels that are expensive to manufacture and necessitate a dedicated office panel that is manufactured separately from other panels. In this manner, pocket doors are not typically suitable as "add-on" components for existing panels in an office partition system.

Privacy doors have also been manufactured as separate, "add-on" units to office partition panels. However, these privacy doors have typically included cumbersome fastening systems which rely on screws, brackets, and other components which require tools to mount the privacy door to a panel.

A need exists for a privacy door that is both easily attachable to an existing panel and movable to provide or restrict access to an interior space.

SUMMARY

The present disclosure provides an office partition system including at least first and second panels and a sliding privacy door guidably supported against the first panel via an elongated horizontal guide. The elongated horizontal guide has a channel that receives the privacy door and a mounting structure for mounting the guide to a horizontal track of the first panel. The elongated horizontal guide has a width that is substantially equivalent to the width of the first panel. The privacy door includes wheels that may support the entire weight of the privacy door. The privacy door may move from a first, open position allowing access to an interior space of the office partition system via an opening to a second, closed position restricting access to the interior space via the opening.

in one form thereof, the present disclosure provides an office partition system, including at least first and second panels having respective panel side edges spaced from one another to define an opening therebetween, the first panel having a panel width and including a first face and a second, opposite face, an elongate horizontal guide mounted to the first face, the elongate horizontal guide including a channel having a width substantially equivalent to the panel width, and a privacy door. The privacy door includes a frame including a top edge, a bottom edge, and a pair of side edges, at least one wheel attached to the bottom edge, the at least one wheel supporting an entire weight of the privacy door, and the top edge received within the guide channel, the privacy door moveable within the guide channel between a first position allowing access through the opening, and a second position restricting access through the opening.

In another form thereof, the present disclosure provides an office partition system, including at least first and second panels having respective panel side edges spaced from one another to define an opening therebetween, the first panel having a panel width and including a first face and a second, opposite face, the first face including a horizontal track, an elongate horizontal guide separate from, and mounted to, the horizontal track, the elongate horizontal guide including a channel, and a privacy door. The privacy door includes a frame comprising a top edge, a bottom edge, and a pair of side edges, the top edge of the frame received within the guide channel, and a pair of wheels attached to the bottom edge, the privacy door moveable within the guide channel via the pair of wheels between a first position allowing access to the opening, and a second position restricting access to the opening.

BRIEF DESCRIPTION OF THE DRAWINGS

The above-mentioned and other features and advantages of this disclosure, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplifications set out herein illustrate an exemplary embodiment of the invention, and such exemplifications are not to be construed as limiting the scope of the disclosure in any manner.

DETAILED DESCRIPTION

An office partition system may include a plurality of panels that form an interior space that may be used as an office, wherein an office resident may access the interior space via an opening between at least two of the plurality of panels. The office may include office items such as a chair, a desk, and shelving units that are attachable to walls of the panels that form the office space. At times, the office resident may desire privacy, for example, to participate in a teleconference, to discuss delicate or confidential matters, or to work undisturbed.

Figure 1:
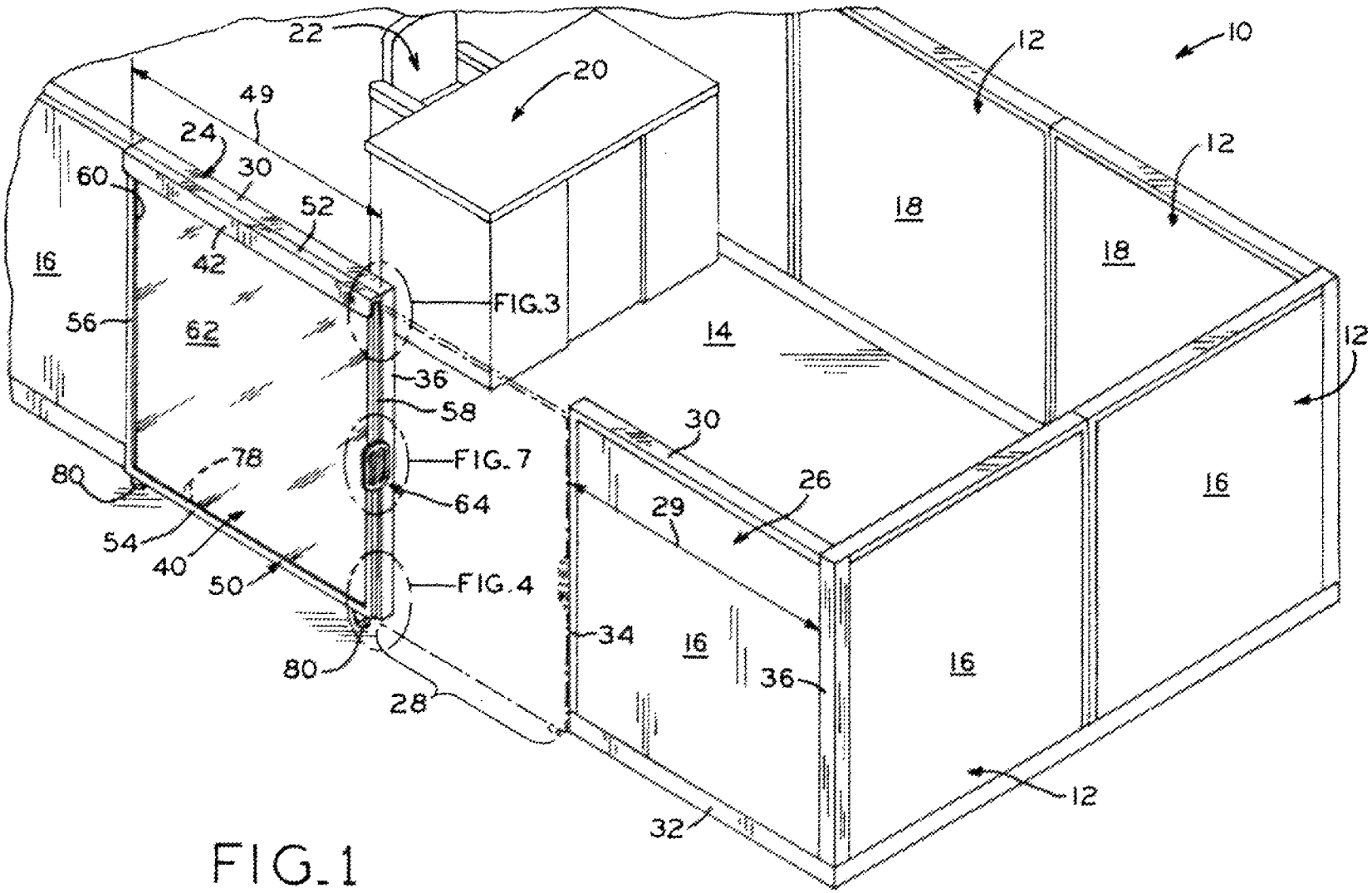
FIG. 1 is perspective view of an office partition system including a panel having a privacy door according to the present disclosure.

Referring to FIG. 1, office partition system 10 includes a plurality of panels 12 that form interior space 14. Exterior or first faces 16 of panels 12 face an opposing, exterior space of the office partition system. The opposing, exterior space may be an interior space of another partition system, in which case the exterior surface 16 of panels 12 of FIG. 1 may also be interior surfaces for another office space (not shown). Interior or second faces 18 of panels 12 face interior space 14. Interior space 14 may be part of an office space conference room, or other interior space. For example, desk 20 and chair 22 are shown in interior space 14 in FIG. 1.

The plurality of panels 12 include first panel 24 having a side edge spaced from a side edge of second panel 26 to define opening 28 between the panels. Each panel includes top frame member 30, bottom frame member 32, and a pair of vertical side frame members 34 and 36 connecting top frame member 30 to bottom frame member 32 and defining the opposite side edges of the panels, between which a panel width 29 is defined. Opening 28 provides an office resident access to interior space 14. Privacy door 40, shown in FIG. 1 and described below, is used to restrict access to interior space 14.

Privacy door 40 is associated with the first, exterior surface 16 of first panel 24 via elongate horizontal guide 42. As described below, this arrangement places interior face 44 (FIG. 5) of privacy door 40 in an orientation facing, and spaced from, the exterior or first face 16 of first panel 24. Further, as discussed below, elongate horizontal guide 42 is separate from, and mounted to, horizontal track 46 (FIG. 3) on first face 16 of first panel 24 and includes guide channel 48. Elongate horizontal guide 42 may advantageously be mounted to horizontal track 46 without the use of fasteners or tools. Guide channel 48 guidingly receives privacy door 40 for movement between open and closed positions, as described in detail below.

Figure 2:
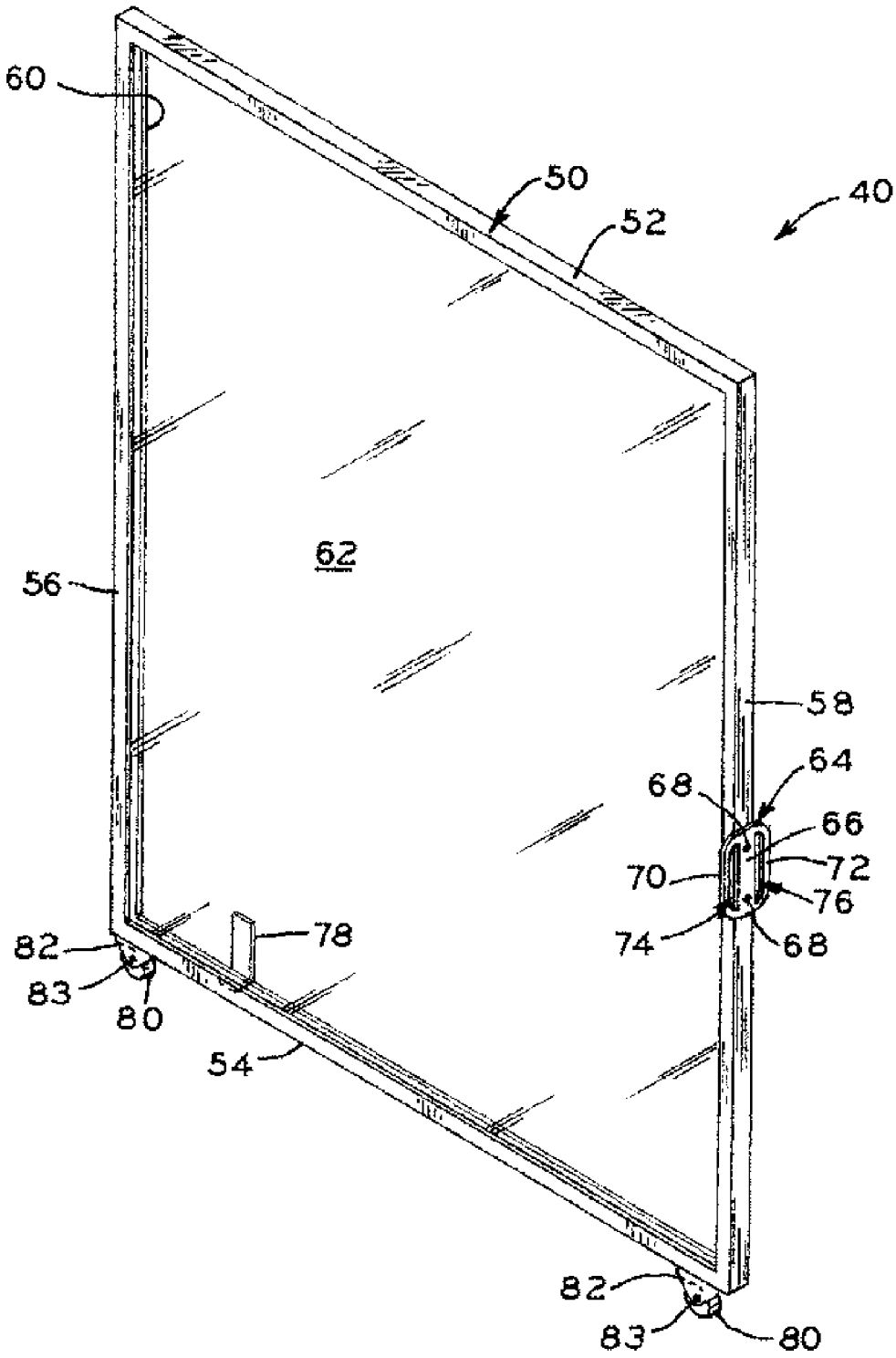
FIG. 2 is a perspective view of the privacy door of FIG. 1.

Referring to FIG. 2, privacy door 40 includes frame 50 having vertical and horizontal frame members defining top edge 52, bottom edge 54, and a pair of side edges 56 and 58 connected to and extending between top edge 52 and bottom edge 54. Top edge 52, bottom edge 54, and the pair of side edges 56 and 58 further define an interior frame area 60, and screen 62, described in greater detail below, is positioned within interior frame area 60.

Privacy door 40 (FIG. 2) is a lightweight door generally including frame 50 and screen 62. Screen 62 may be made of an opaque material or alternatively, screen 62 may be made of a translucent or semi-translucent material. Privacy door 40 may be relatively thin, having a thickness between about 0.5 inches and about 1.5 inches, for example. In one embodiment, privacy door 40 is 48 inches wide and may have an extension range of about 36 inches to about 42 inches from an initial position in which frame 50 of privacy door 40 is aligned with the frame of first panel 24. The range of extension depends on the location of stop member 78 along bottom frame 32 of first panel 24, as discussed below.

Figure 7:
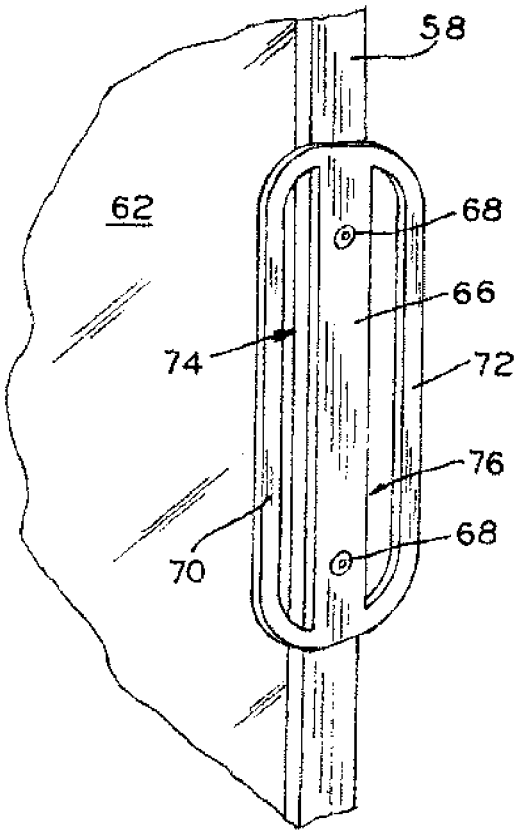
FIG. 7 is an enlarged, fragmentary view of the privacy door of FIG. 1, showing handle.

Further, privacy door 40 includes an optional handle 64 attached to side edge 58 which, in one embodiment, is made from a 12-gauge flat plate formed of galvanized steel. Privacy door 40 is movable along guide channel 48 using handle 64 in the manner described below. Referring to FIG. 7, handle 64 includes mounting plate 66 attached to side edge 58 of privacy door 40 via fasteners 68, and further includes a pair of grips 70 and 72 defining grip apertures 74 and 76 dimensioned for grasping by a user.

Stop member 78 (FIG. 2) also assists with movement of privacy door 40, as described in detail below, and is attached to bottom edge 54 of frame 50. Additionally, at least one wheel 80 is attached to bottom edge 54 of frame 50 via a wheel assembly including wheel bracket 82 having axle 83 to which wheel 80 is mounted. Wheels 80 may support the entire weight of privacy door 40, including frame 50 and screen 62. Other means for moving privacy door 40 may be attached to bottom edge 54 of frame 50, such as wheels movable in a confined, linear direction, wheels moving in a rotatable manner, glide structures, conveyor-like structures, or a plurality of wheels separate from or built into the bottom edge of privacy door 40.

Figure 3:
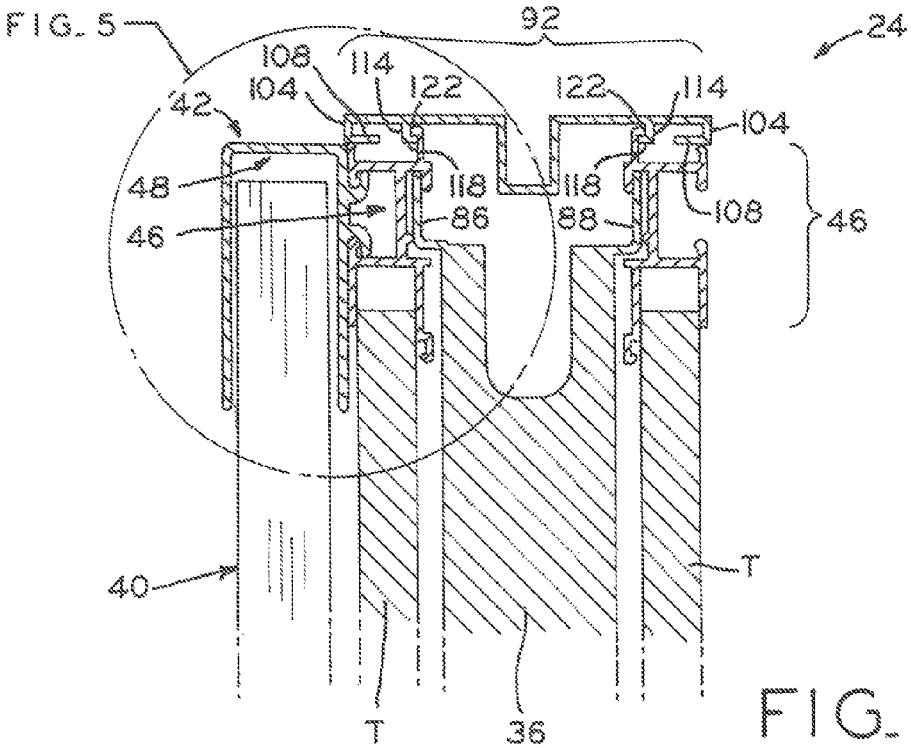
FIG. 3 is a cross-sectional view of the upper end of the privacy door and panel of FIG. 1.

The lightweight design of privacy door 40 assists with ease of attaching privacy door 40 to first panel 24. This installation is shown in detail in FIGS. 3 and 4. Referring to FIG. 3, the top edge 52 of privacy door 40 and the upper portion of first panel 24 are shown. First panel 24 includes horizontal tracks 46 on both its exterior, first face 16 and its interior, second face 18. The interior tracks may receive modular accessory items, for example, such as cabinets or shelving units, positioned within the workspace. Other possible track designs and uses for such tracks are within the scope of this disclosure, such as those described in U.S. Pat. No. 5,309,686, entitled WORK SPACE PARTITION SYSTEM, issued May 10, 1994, and U.S. Pat. No. 7,540,115, entitled PARTITION SYSTEM, issued Jun. 2, 2009, the entire disclosures of which are expressly incorporated by reference herein.

Referring back to FIG. 1, top edge 52 of privacy door 40 is received within guide channel 48. Guide channel 48 has a width 49 which, in one embodiment, is substantially equivalent to panel width 29 between vertical side frame members 34 and 36 of first panel 24. Privacy door 40 is movable, or slidable via the pair of wheels 80, within guide channel 48 between a first position and a second position. While in the first position, privacy door 40 is positioned facewise adjacent first panel 24 to allow access to interior space 14 of office partition system 10 through opening 28 between first and second panels 24 and 26. While in the second position, privacy door 40 spans the distance between first and second panels 24 and 26 across opening 28 to restrict access to interior space 14 of office partition system 10.

Figure 5:
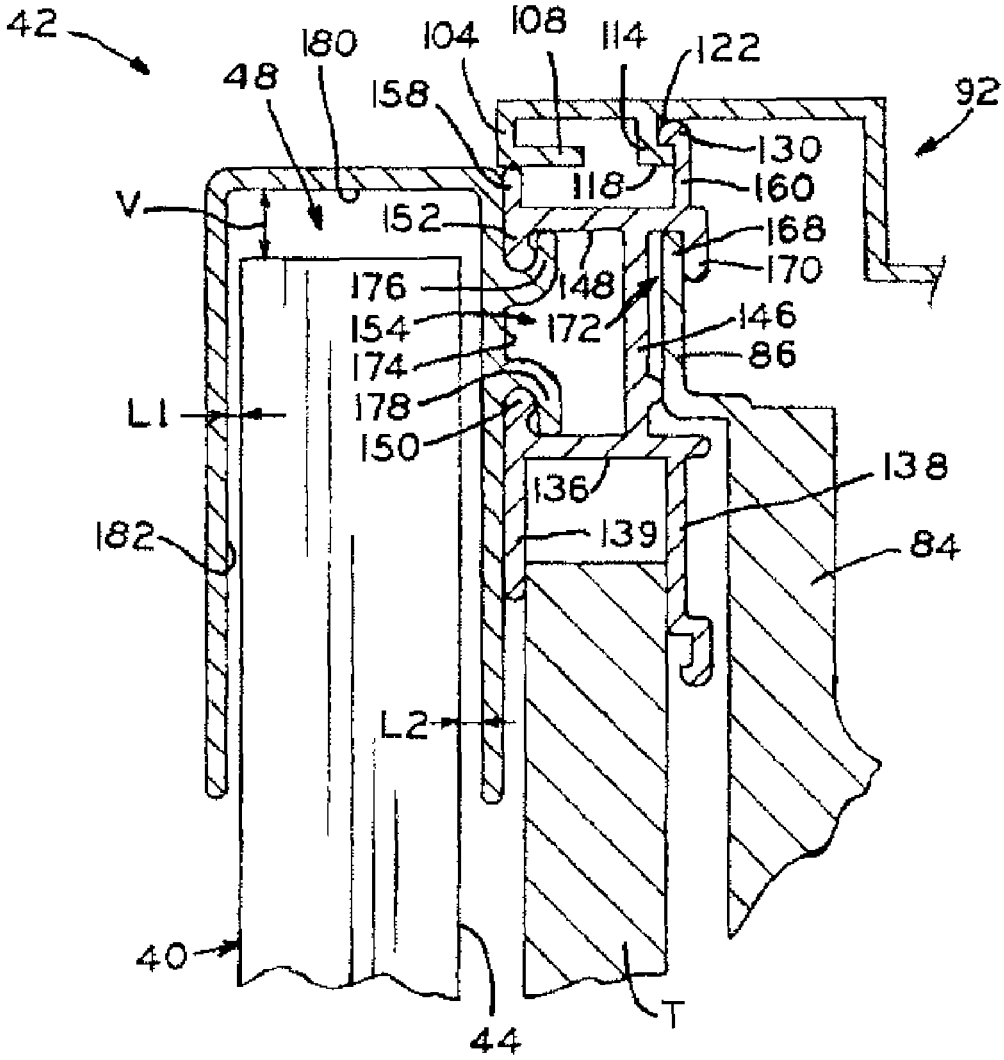
FIG. 5 is an enlarged, fragmentary view of a portion of FIG. 3.

Referring to FIGS. 3 and 5, first panel 24 further includes vertical side frame member 36, which is attached to a top horizontal frame member having a pair of vertical flanges 86 and 88. Horizontal tracks 46 are positioned over vertical flanges 86 and 88 and top cap 92 is supported on tracks 46.

Top cap 92 includes flanges 104 at its opposite ends, as well as interiorly positioned flanges 114. Flanges 104 have horizontally and inwardly projecting lips 108, and flanges 114 have horizontally and inwardly projecting lips 118. Lips 118 forms notches 122 which connect top cap 92 to lips 130 of horizontal track 46.

Referring to FIGS. 3 and 5, horizontal tracks 46 are identical in structure and face in opposite directions. As such, identical reference numbers are used to describe identical components of the tracks. Horizontal track 46 includes horizontal bottom wall 136 connecting a pair of first and second vertical walls 138 and 139 that are dimensioned to receive tile T. Rear wall 146 connects horizontal bottom wall 136 to horizontal upper wall 148 to form a receiving space or channel 154 of horizontal track 46. Horizontal track 46 further includes a pair of flanges 150 and 152 projecting towards one another and which extend from horizontal bottom wall 136 and horizontal upper wall 148, respectively, to form an opening into channel 154 of horizontal track 46.

A pair of vertical flanges 158 and 160 extend from upper wall 148. Flange 158 is aligned with at least one of the pair of flanges 150 and 152 of horizontal track 134. Internally positioned flange 160 includes lip 130 which is engaged by notch 122 of top cap 92 to connect top cap 92 to horizontal track 46. An L-shaped flange 170 extends from rear wall 146 for positioning tracks 46 on flanges 86 or 88.

Horizontal tracks 46 may be positioned on one or both of the interior, second face 18 and the exterior, first face 16 of panel 24. The horizontal track 46 positioned on the exterior, first face 16 of panel 24 receives elongated horizontal guide 42. Guide 42 includes vertical rear wall 174 and guide channel 48 defined by top horizontal wall 180 connecting vertical front wall 182 to vertical rear wall 174. Top edge 52 of privacy door 40 is guidably received within guide channel 48.

Rear wall 174 of elongate horizontal guide 42 includes a pair of flanges 176 and 178, with the ends of flanges 176 and 178 projecting away from one another and receivable within channel 154. Elongate horizontal guide 42 may be connected to track 46 in the following manner. In a first method, flanges 176 and 178 of guide 42 are dimensioned such that guide 42 may first be positioned with respect to track 46 at an angle, followed by inserting flange 176 into channel 154 of track 46 behind flange 152. Then, guide 42 is moved to a vertical position with concurrent insertion of flange 178 into channel 154 of track 46, followed by moving guide 42 downwardly to engage flange 178 behind flange 150 with each of flanges 176 and 178 of guide 42 engaging behind flanges 152 and 150 of track 46, respectively. In another manner, if an open end of track 46 is exposed, guide 42 may be inserted longitudinally within the open end of track 46 and slid into position with flanges 176 and 178 of guide 42 engaging behind flanges 152 and 150 of track 46, respectively.

Figure 4:
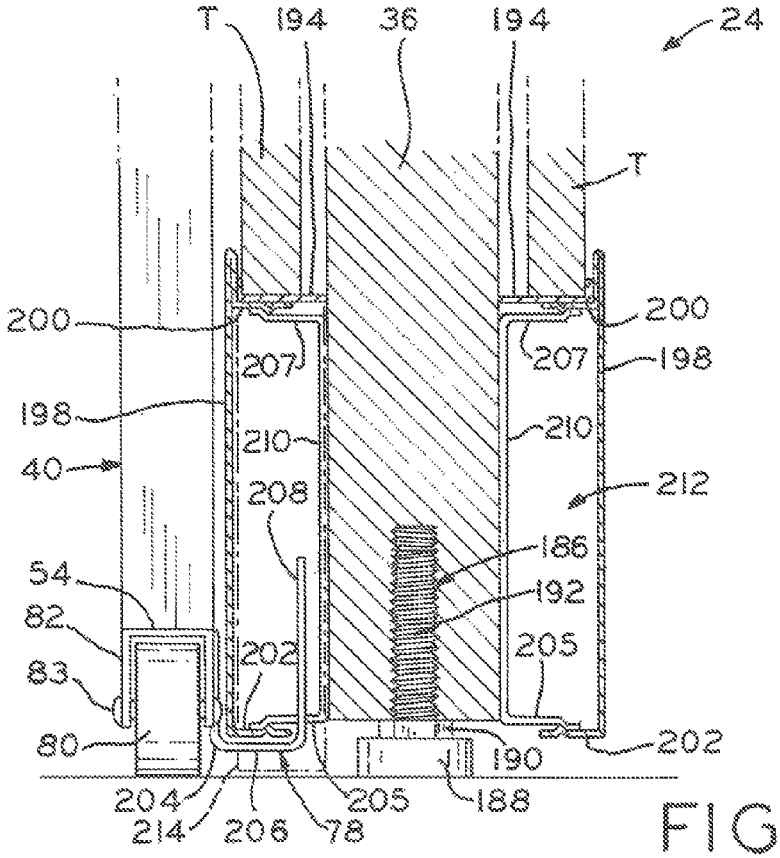
FIG. 4 is a cross-sectional view of the lower end of the privacy door and panel of FIG. 1.

Referring to FIG. 4, a lower portion of vertical side frame member 36 includes leveling glide 186. Leveling glide 186 includes head 188 and threaded screw 192 projecting upwardly from head 188 and threaded into a threaded bore of frame member 36. Leveling glide 186 may be threadingly rotated within the threaded bore of frame member 36 to vary the position of leveling glide 186 and in turn adjust the height of panel 24. Referring to FIGS. 3 and 4 together, it may be seen that, with privacy door 40 resting on a ground surface, the height of the first panel 24 may be adjusted to level panel 24 as needed, and in turn to vary the position of panel 24 and elongate horizontal guide 42 relative to the upper edge of privacy door 40. In this manner, even with privacy door 40 received within guide channel 48, panel 24 may be leveled as needed without affecting the position of privacy door 40.

In particular, referring to FIG. 5, privacy door 40 is loosely received within guide channel 48, allowing for a clearance space or gap to exist between top edge 52 of privacy door and guide channel 48. Lateral clearances L1 and L2 exist between lateral walls of top edge 52 of privacy door 40 and the pair of lateral walls 182 and 184 of guide channel 48, respectively. Further, vertical clearance V exists between top edge 52 of privacy door 40 and top horizontal wall 180 of guide channel 48. Based on the positioning of leveling glide 186 and panel 24 to which guide channel 48 is connected, guide channel 48 is in turn vertically adjustable with respect to privacy door 40 to vary the distance of vertical clearance V and, in this manner, the position of panel 24 and guide channel 48 may be adjusted in order to level panel 24 without affecting the position of privacy door 40.

Further referring to FIG. 4, bottom edge 54 of privacy door 40 adjacent to first panel 24 is shown. Components such as L-shaped horizontal extension 194 of bottom frame member 32 are identical on both sides of first panel 24 and, hence, identical reference numbers are used for identical components on either side. Horizontal extension 194 defines a space to receive a bottom of tile T. Electrical raceway cover 198 covers a bottom portion of tile T from view.

First horizontal extension 200 of raceway cover 198 abuts a bottom edge of horizontal extension 194 and forms a snap fit connection with upper portion 207 of bracket 210. At a lower end, raceway cover 198 includes second horizontal extension 202 secured to lower portion 205 of bracket 210 via a snap fit connection. Raceway cover 198 and bracket 210 together define interior space or raceway 212 for receipt of electrical components such as cables and wires.

Stop member 78 is mounted to the lower end of privacy door 40, and includes a first vertical portion 204 mounted to bottom edge 54 of privacy door 40 in a suitable manner, a horizontal portion 206 extending from first portion 204 beneath extension 202 of raceway cover 198 and disposed between extension 202 and the floor surface, and a second vertical portion 208 extending from portion 206 and received within a gap provided between raceway cover 198 and vertical side frame member 36. Alternatively, stop member 78 may terminate with bottom portion 206 and not include second vertical portion 208.

Figure 6:
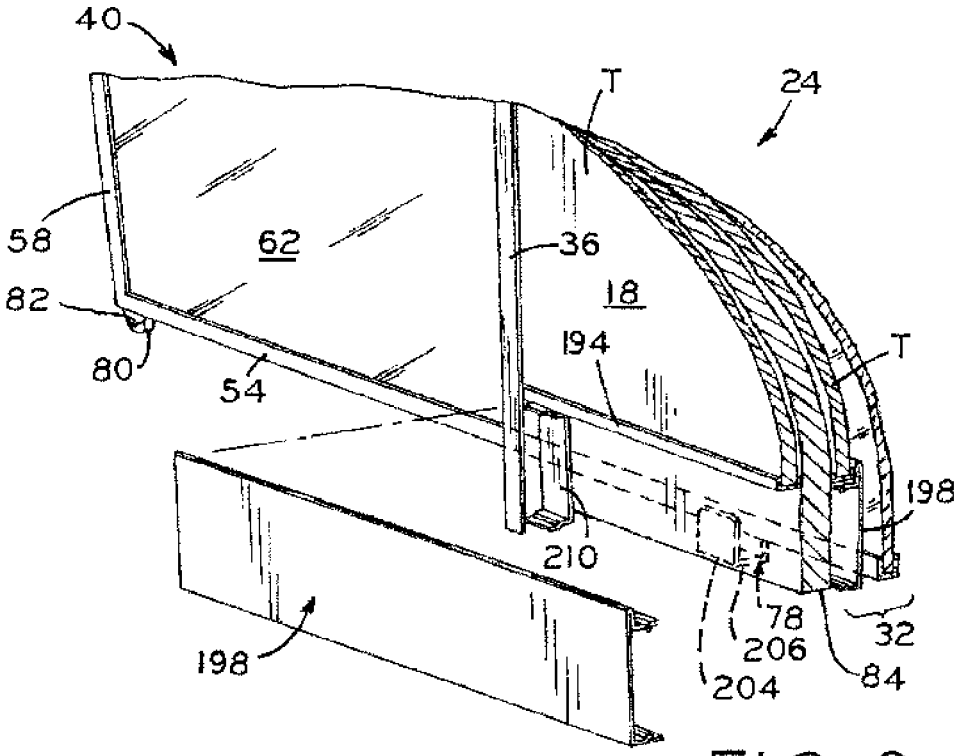
FIG. 6 is an exploded bottom view of a portion of the lower region of the panel and the privacy door of FIG. 1.

Stop member 78 functions to stop privacy door 40 as privacy door 40 moves from an open position to a closed position. Referring to FIGS. 1 and 6, privacy door 40 is slidable into a position partially or fully restricting access to opening 28 (FIG. 1) leading to interior space 14. Referring to FIG. 6, bracket 210 is mounted to a portion of first panel 24. For example, as shown in FIG. 6, bracket 210 may be mounted to vertical frame member 36 on bottom frame member 32 of first panel 24. When privacy door 40 is slid from an open position toward a closed position, stop member 78 moves towards bracket 210. When privacy door 40 is in a closed position and/or at its full extension, stop member 78 abuts bracket 210. Alternatively, stop member 78 may travel underneath bracket 210 to abut vertical post 214, which may be the lower end of vertical frame member 36 of first panel 24, to limit the travel of privacy door 40 to its closed or full extension position.

As disclosed herein, the overall width of privacy door 40 is substantially equivalent to that of the panel 24 with which privacy door 40 is associated. However, in other embodiments, the width of privacy door 40 may be greater than, or less than, the width of the panel with which it is associated, depending upon the width of the opening 28 between adjacent panels in a partition system for which privacy door 40 is designed to close. Also, as described herein, the width of horizontal guide 42 is approximately the same as that of both privacy door 40 and the panel 24 with which privacy door 40 is associated. However, this is not strictly necessary although, when the width of horizontal guide 42 is approximately equal to that of privacy door 40, horizontal guide 42 advantageously guidably supports the upper end of privacy door 40 throughout its full extent of travel, thereby allowing a smooth sliding motion of privacy door 40 between its open and closed positions.

Additionally, as described above, the act that the entire weight of privacy door 40 is supported by wheels 80, and that the upper end of privacy door 40 is loosely received within elongate horizontal guide 42 allows the position of panel 24 to be leveled using the leveling glides of the panel 24 even after privacy door 40 is installed with respect to panel 24.

Further, horizontal guide 42 may be easily mounted to an existing track 46 of an office partition panel without the need for tools or other fasteners, followed by inserting the upper end of privacy door 40 within guide channel 48 of horizontal guide 42 to thereby install privacy door 40 with respect to panel 24. In this manner, privacy door 40 may easily be fit onto existing panels 24 in an office partition system without the need for tools and with minimal installation effort.

While this invention has been described as having an exemplary design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which hill within the limits of the appended claims.

What is claimed is:

1. An office partition system, comprising:

at least first and second panels having respective panel side edges spaced from one another to define an opening therebetween;

said first panel having a panel width defined between opposite side cages of said first panel, said first panel further including an upper portion, a lower portion, a first face, a second, opposite face, and an interior defined between said first and second faces;

an elongate horizontal guide mounted to said first face, said elongate horizontal guide including a channel having a length substantially equal to said panel width; and a privacy door comprising:

a frame including a top edge, a bottom edge, and a pair of side edges, at least one wheel attached to said bottom edge, said at least one wheel supporting an entire weight of said privacy door, and said top edge received within said guide channel, said privacy door moveable within said guide channel between a first position allowing access through said opening and a second position restricting access through said opening.

2. The office partition system of claim 1, wherein said top edge, said bottom edge, and said pair of side edges of said frame define an interior frame area, said privacy door further including a screen positioned within said interior frame area.

3. The office partition system of claim 1, further comprising a stop member attached to said bottom edge of said frame of said privacy door, said stop member comprising a vertical portion extending vertically into said interior of said first panel.

4. The office partition system of claim 1, wherein said top edge is received within said guide channel with at least one clearance gap between said top edge and said guide channel.

5. The office partition system of claim 4, wherein said clearance gap comprises lateral clearances between respective lateral walls of said top edge and lateral walls of said guide channel.

6. The office partition system of claim 4, wherein said clearance gap comprises a vertical clearance between said top edge and a top wall or said guide channel.

7. The office partition system of claim 6, wherein said first panel further includes a leveling glide operable to adjust a height of said panel and to in turn vary said clearance gap.

8. The office partition system of claim 1, wherein said first face of said first panel comprises a horizontal track, said elongate horizontal guide mounted to said horizontal track.

9. The office partition system of claim 1, wherein said privacy door further comprises an interior face, said interior face facing, and spaced from, said first face of said first panel.

10. The office partition system of claim 1, wherein said privacy door has a thickness between 0.5 inches and 1.5 inches.

11. An office partition system, comprising:

at least first and second panels having respective panel side edges spaced from one another to define an opening therebetween;

said first panel including an upper portion, a lower portion, a first face, a second, opposite face, and an interior defined between said first and second faces, said first face including a horizontally outwardly facing horizontal track defining an elongated horizontal opening;

an elongate horizontal guide separate from, and mounted within said opening of said track, said elongate horizontal guide including a channel; and a privacy door comprising:

a frame including a top edge, a bottom edge, and a pair of side edges, said top edge of said frame received within said guide channel, and a pair of wheels attached to said bottom edge, said privacy door moveable within said guide channel via said pair of wheels between a first position allowing access to said opening, and a second position restricting access to said opening; and a stop member attached to said bottom edge of said frame, said stop member comprising a vertical portion extending vertical to said interior of said first panel.

12. The office partition system of claim 11, wherein said top edge is received within said guide channel such that a vertical clearance exists between said top edge and a top wall of said guide channel, and said first panel further comprises a leveling glide operable to adjust a height of said panel and to in to vary said clearance.

13. The office partition system of claim 11, wherein said privacy door further comprises an interior face, said interior face facing, and spaced from, said first face of said first panel.

14. The office partition system of claim 11, wherein said horizontal track further comprises at least one track flange and said elongate horizontal guide further comprises at least one guide flange, said elongate horizontal guide mounted to said horizontal track of said first face of said first panel by receipt of said guide flange into said opening of said track behind said track flange.

15. The office partition system of claim 11, wherein said elongate horizontal guide includes at least one flange removably attached to said horizontal track.

16. The office partition system of claim 11, wherein said top edge is received within said guide channel with at least one clearance gap between said top edge and said guide channel.

17. An office partition system, comprising:

a panel including a first face, a second, opposite face, an upper portion and a lower portion, and an interior defined between said first and second faces an elongate horizontal guide mounted to said upper portion of said panel, said guide disposed outwardly of said first face, said panel defining a width between opposite side edges of said panel and said horizontal guide defining a length, said panel width being substantially equal to said length of said horizontal guide; and a privacy door comprising:

a frame including a top edge, a bottom edge, and a pair of side edges, said top edge received within said elongate horizontal guide, at least one wheel attached to said bottom edge, said at least one wheel supporting an entire weight of said privacy door, and a stop member mounted to said bottom edge, said stop member comprising a vertical portion extending vertically into said interior of said panel.

18. The office partition system of claim 17, wherein said panel defines a width between opposite side edges of said panel and said horizontal guide further comprises a channel defining a length, said panel width being substantially equal to said length of said channel.

19. The office partition system of claim 17, wherein said top edge is received within said guide channel with at least one clearance gap between said top edge and said guide channel.

* * * * *

UNITED STATES PATENT AND TRADEMARK OFFICE

CERTIFICATE OF CORRECTION

PATENT NO. : 8,402,699 B2
APPLICATION NO. : 13/178001
DATED : March 26, 2013
INVENTOR(S) : Jay M. Henriott It is certified that error appears in the above-identified patent and that said Letters Patent is hereby corrected as shown below:

In the Claims:

Claim 6, Column 7, Line 58, delete “or” and insert --of--

Claim 11, Column 8, Line 27, delete “vertical to” and insert --vertically into--

Claim 12, Column 8, Line 33, delete “to” and insert --turn--

Claim 17, Column 8, Line 54, delete “faces” and insert --;--

Signed and Sealed this
Twenty-eighth Day of May, 2013

Teresa Stanek Rea
*Acting Director of the United States Patent and Trademark Office*